US005446320A

United States Patent [19]

Scharnberg et al.

[11] Patent Number: 5,446,320

[45] Date of Patent: Aug. 29, 1995

[54] CIRCUIT FOR CLAMPING POWER OUTPUT TO GROUND WHILE THE COMPUTER IS DEACTIVATED

[75] Inventors: Donald G. Scharnberg, Pasadena; Patrick R. Cooper, Houston, both of Tex.

[73] Assignee: Compaq Computer Corp., Houston, Tex.

[21] Appl. No.: 825,000

[22] Filed: Jan. 24, 1992

[51] Int. Cl.[6] ..... H01H 83/00; G05F 3/00

[52] U.S. Cl. ..... 307/100; 323/225; 323/229

[58] Field of Search ..... 307/100; 323/220–233; 361/220, 56, 92

[56] References Cited

U.S. PATENT DOCUMENTS

| | | | |
|---|---|---|---|
| 4,575,641 | 3/1986 | Kolpin | 307/100 |
| 4,692,834 | 9/1987 | Iwashashi et al. | 361/36 |
| 5,086,365 | 2/1992 | Lien | 361/58 |
| 5,122,724 | 6/1992 | Criss | 323/222 |

*Primary Examiner*—Todd DeBoer

*Assistant Examiner*—Richard T. Elms

*Attorney, Agent, or Firm*—Pravel, Hewitt, Kimball & Krieger

[57] ABSTRACT

A circuit for connecting the power supply output of a computer to ground when the system is shut down to counter adverse effects of backfeed voltage which includes a MOSFET between the power supply output and ground. In one embodiment the MOSFET is switched on by a signal that deactivates the system power supply. In an alternative embodiment, two MOSFETs are used. The first MOSFET is controlled directly by the power supply output and shorts the second MOSFET's gate to ground when the power supply output generates a significant voltage. If the second MOSFET's gate is grounded, the MOSFET deactivates and opens a circuit between the power supply output and ground. When the power supply is turned off, the second MOSFET activates and grounds the power supply output. A resistor between the power supply output and ground allows the power supply to generate five volts when the system is power cycled and deactivate the second MOSFET.

32 Claims, 2 Drawing Sheets

CIRCUIT FOR CLAMPING POWER OUTPUT TO GROUND WHILE THE COMPUTER IS DEACTIVATED

BACKGROUND OF THE INVENTION

1. Field of the Invention

The invention relates to computer systems employing peripheral units, and more particularly, to computer systems susceptible to receiving backfeed voltages from operating peripheral units when the computer system is shut down.

2. Description of the Related Art

Computer systems commonly comprise more than just the computer itself. Almost all modern systems also employ several peripheral units, including monitors, modems, hard and floppy disk drives, printers, and a variety of other devices. Although each peripheral unit is a part of the overall computer system, each forms a distinct element and frequently draws power from an independent, separate supply. This independent supply is particularly true of monitors and printers. Each peripheral unit also generates signals to communicate with other parts of the system, with the signals transmitted by connections between the peripheral unit and a peripheral interface component in the computer.

In the preferred embodiments of the present invention, the peripheral interface includes an Intel 82360 SL dedicated logic chip, which includes serial ports, a parallel port, and a real time clock. The 82360 SL chip is equipped with electrostatic discharge (ESD) diodes to prevent damage to the system components caused by signal voltages that are either too high or too low. ESD diodes are usually a diode connected between the signal bus and ground to handle negative voltages and another diode between the signal bus and the power supply output to handle excess positive voltages. Effective limiting voltages for the diodes are about −2 volts and 7 volts, respectively, for five volt signal systems.

When the computer is shut down, some of the peripheral units like printers may continue operating from their individual power supplies. The peripheral unit continues to send logic signals to the computer through the peripheral interface, including five volt logic high signals. Although the computer is not activated, the computer's peripheral interface inputs receive these signals. Because the computer power supply is deactivated, the power supply output generates no voltage, creating an approximately five volt difference across the ESD diode between the logic high signal received from the peripheral unit and the power supply output. As a result, the limiting voltage of the ESD diode is exceeded and the voltage is passed to the power supply output connection. This voltage transfer creates a backfeed voltage, an inadvertent voltage at the power supply output which propagates to the various integrated circuits of the computer. If the computer has an effective low resistance to ground, this backfeed voltage may not develop, but in a lower power computer, such as a notebook computer, the effective resistance to ground may be relatively high. Consequently, a significant voltage can be asserted on the integrated circuit supply connections within the computer, even though the computer's power supply is not operating.

Of particular interest in the preferred embodiment, when a backfeed voltage above a given level is developed, the operation of the real time clock (RTC) in the 82360 SL may be affected, causing an increase in the current drawn by the RTC. A current consumption increase of as much as two orders of magnitude greater than when the RTC is operating properly has been observed. The batteries used with the RTC are conventionally small lithium cells with a limited charge and no recharging capability. As a result of the current increase, the RTC rapidly drains the RTC battery and eventually fails prematurely.

SUMMARY OF THE INVENTION

A computer system according to the present invention includes a transistor circuit for connecting the computer power supply output to ground when the computer is shut down. The connection to ground greatly reduces the backfeed voltage and prevents it from affecting the operation of the real time clock and other computer components.

When the computer system is powered up, the transistor circuit is open, which disconnects ground from the power supply output and allows the supply output to maintain five volts during normal operation. When the system is shut down, the transistor circuit turns on to connect the power supply output to ground. Consequently, if a backfeed voltage arises, it is greatly reduced by the connection to ground.

In the first preferred embodiment, a MOSFET circuit according to the present invention comprises a transistor connected between the power supply output and ground. The MOSFET is controlled by a POWERON* signal, the signal used to activate the power supply for the computer system. POWERON* is an active low signal, so that the power supply activates when POWERON* is asserted low. When POWERON* is asserted high, the power supply shuts down, and the transistor circuit is activated. Consequently, the power supply output is connected through the MOSFET to ground while the power supply is deactivated.

In the second preferred embodiment, a transistor circuit according to the present invention comprises two MOSFETs. The first MOSFET is controlled by the power supply output. The drain of the first MOSFET is connected to the gate of the second MOSFET and a resistor connected to the battery for the RTC. When the power supply voltage drops, the first MOSFET permits the RTC battery to activate the second MOSFET. When the second MOSFET is activated, it connects the power supply output to ground through a resistor. When the system is again powered up, the first MOSFET is activated, which turns off the second MOSFET, and disconnects the power supply output from ground to permit normal operation of the computer.

BRIEF DESCRIPTION OF THE DRAWINGS

A better understanding of the invention can be had when the following detailed description of the preferred embodiment is considered in conjunction with the following drawings, in which.

DETAILED DESCRIPTION OF THE PREFERRED EMBODIMENTS

Figure 1:
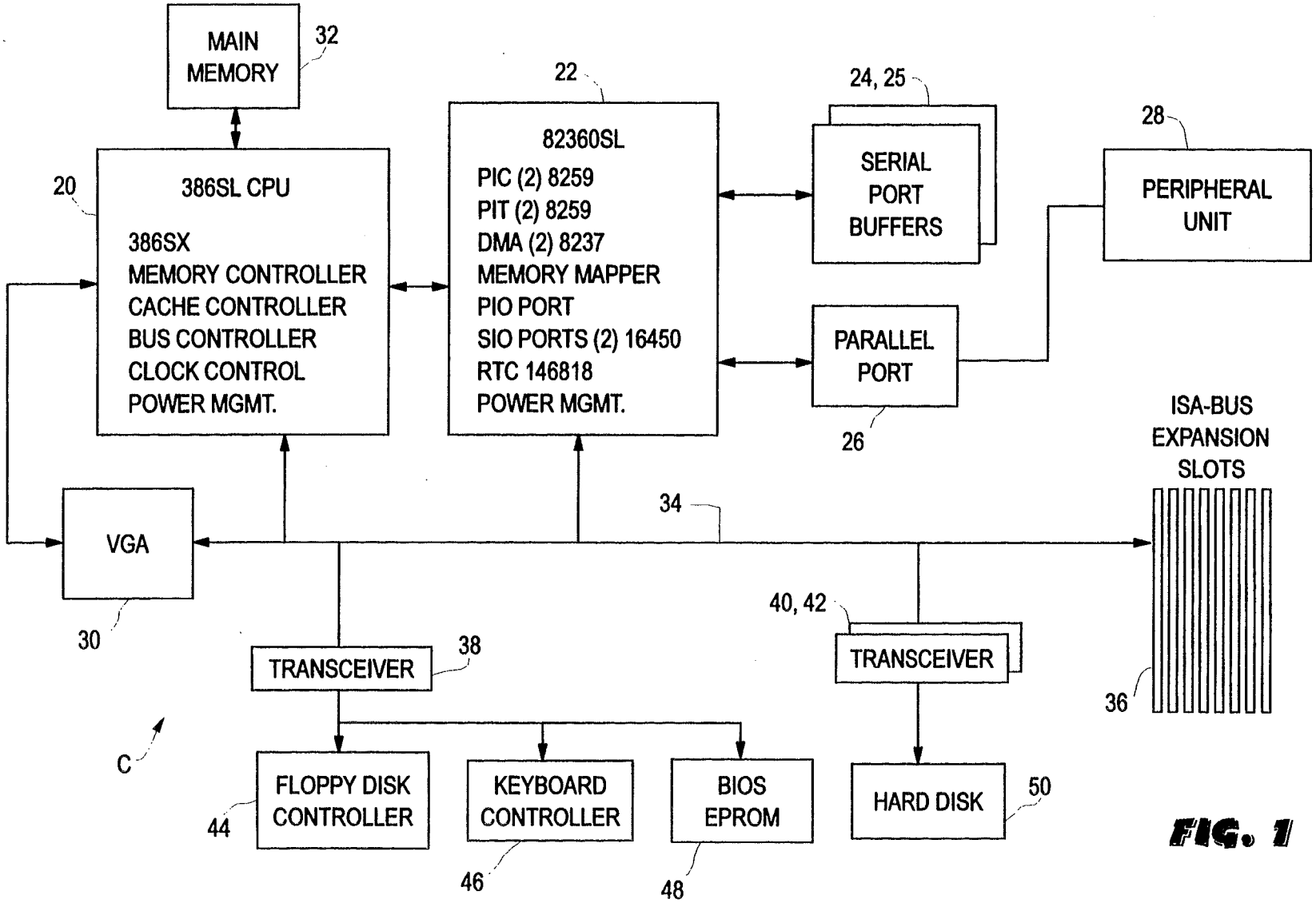
FIG. 1 is a block diagram of a computer system compatible with the present invention having a peripheral unit.

Referring to FIG. 1, the letter C generally refers to a computer system compatible with the present invention. In the preferred embodiment, the computer C includes an Intel Corporation 386 SL central processing unit (CPU) 20, which includes a microprocessor, a memory controller, a cache controller, a bus controller, and clock control and power management systems. The computer C also includes an Intel 82360 SL chip dedicated logic chip 22 connected to the CPU 20 which contains a pair of serial ports, a parallel port, timers, interrupt and direct memory access (DMA) controllers, and a real time clock. More information on the 386 SL and 82360 SL can be obtained from the 1990 386 SL Microprocessor Superset System Design Guide and the 386 SL Microprocessor superset Data Book, October, 1990, both available from Intel. The 82360 SL chip 22 also includes some keyboard, floppy disk drive, and hard disk drive support apparatus. A pair of serial port buffers 24, 25 and in some instances, a parallel port buffer 26 are connected to the 82360 SL chip 22 to permit connections to other devices. A peripheral unit 28 like a printer is connected to the parallel port buffer 26. Alternatively the peripheral unit 28 may be directly connected to the 82360 SL chip 22. The CPU 20 is further coupled to a VGA monitor 30 and main memory 32. Both the CPU 20 and the 82360 SL chip 22 are coupled to an ISA (industry standard architecture) bus system 34, which may be connected to a series of expansion slots 36, and a set of transceivers 38, 40, 42 for communication with various subsystems. The transceivers 38, 40, 42 are connected to a floppy disk controller 44, a keyboard controller 46, a BIOS EPROM 48, and a hard disk drive 50.

Figure 2:
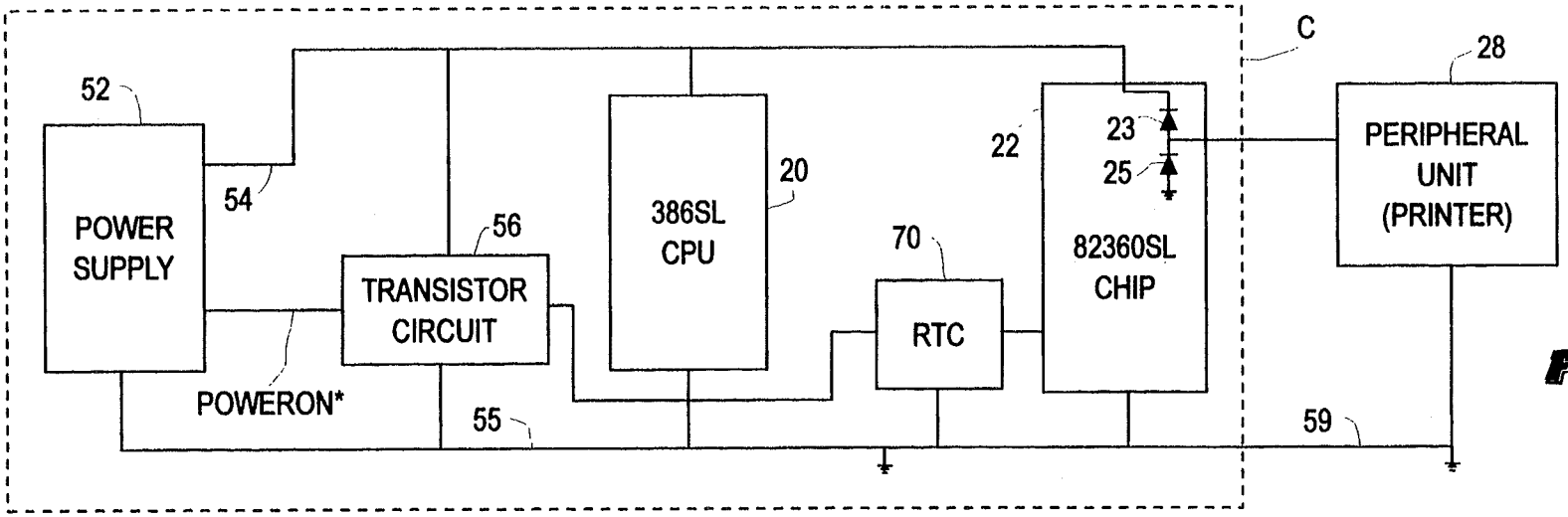
FIG. 2 is a simplified diagram of the computer system of FIG. 1 showing the power supply and a transistor circuit according to the present invention.

Referring now to FIG. 2, a simplified version of the computer system C is shown. The computer system C includes the CPU 20, the 82360 SL chip 22, and the peripheral unit 28. As noted in the background, the inputs of the 82360 SL chip 22 include an ESD diode 23 to a power supply output 54 and an ESD diode 25 to ground. The computer C is powered by a power supply 52 connected to each component of the computer C. The power supply 52 may include batteries for providing power and a DC-DC converter to develop 5 volts from the battery voltage. The power supply 52 is manually controlled, and supplies power to the CPU 20, the 82360 SL chip 22, and the rest of the computer C through the power supply output 54 or computer supply voltage line, which electrically connects to transistor circuit 56, the 386 SL CPU 20 and the 82360 SL chip 22, each of which is further electrically connected to ground reference line 55. The peripheral unit power supply line 57 is connected to the chip 22 in a known manner, and the peripheral unit ground reference line 59 is connected to computer ground reference line 55. A transistor circuit 56 according to the present invention is also connected to the power supply output 54 in parallel with the CPU 20, the 82360 SL chip 22, and the other computer components.

In the preferred embodiments, the transistor circuit 56 employs n-channel enhancement mode MOSFETs. N-channel enhancement MOSFETs are readily available exhibiting low resistance between the drain and source and are activated by a positive gate voltage, typically in the range of 3 to 5 volts. Consequently, a MOSFET can be turned on by a voltage connected to the gate and ground the power supply output 54.

Figure 3:
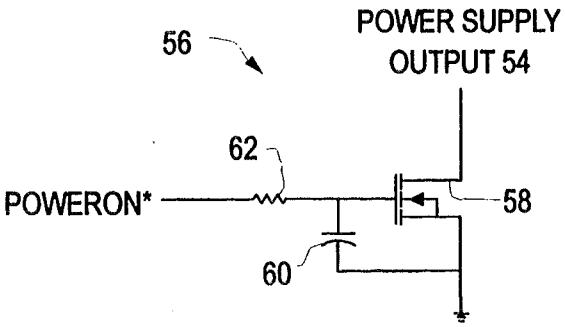
FIG. 3 is a schematic diagram of a first preferred embodiment of the transistor circuit using a single n-channel enhancement mode MOSFET.

Referring now to FIG. 3, the first preferred embodiment of the transistor circuit 56 is shown. The drain of a MOSFET 58 is connected to the power supply output 54, and its source is grounded. To maintain an open circuit when the MOSFET 58 is deactivated, the drain must be connected to the power supply output 54 and the source to ground so that the inherent diode is reverse-biased. If the orientation of the MOSFET 58 is reversed, the power supply output 54 will effectively be grounded regardless of whether the MOSFET 58 has been activated and the MOSFET 58 will be destroyed when the power supply 52 is activated. A capacitor 60 is connected to the gate of the MOSFET 58 with its other terminal grounded. A resistor 62 is also connected to the gate, and the second terminal of the resistor 62 is connected to a POWERON* signal.

The POWERON* signal activates the power supply 52 when the computer system C is powered up. When the manual power switch for the computer C is activated, the POWERON* signal is asserted low if sufficient power is available to supply the system. In response to the low POWERON* signal, the power supply 52 begins to generate a positive 5 volts at the power supply output 54. When the low POWERON* signal is asserted at the gate, however, the MOSFET 58 deactivates. Therefore, the connection between the MOSFET's drain and source is open circuited, and the main power supply output 54 can maintain five volts.

Conversely, when the system deactivates, the POWERON* signal is asserted high by a pull-up resistor connected to the batteries in the power supply 52. When the POWERON* signal goes high, the voltage at the gate of the MOSFET 58 does not immediately rise. Because of the resistor 62 and capacitor 60 circuit, a slight delay occurs between the time the POWERON* signal goes high and the MOSFET 58 activates. This delay assures that the 5-volt power supply 52 is turning or turned off when the MOSFET 58 is activated. After the short delay, the high voltage is asserted at the gate of the MOSFET 58, which activates the MOSFET 58. When the MOSFET 58 is activated, the drain-to-source resistance drops to nearly zero. Thus, the MOSFET 58 effectively short circuits the main power supply output 54 to ground and counters any backfeed voltage.

Figure 4:
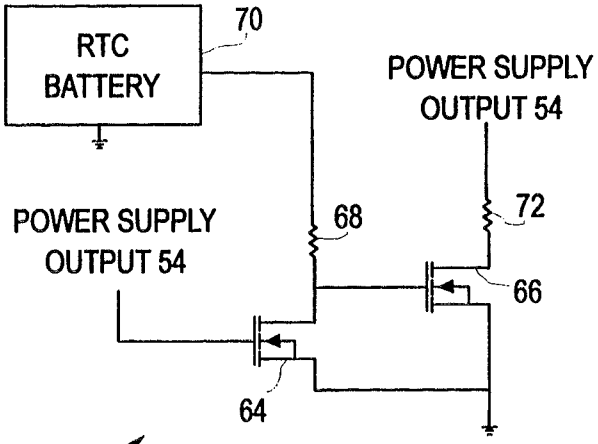
FIG. 4 is a schematic diagram of a second preferred embodiment of the transistor circuit using a pair of n-channel enhancement mode MOSFETs.

The second preferred embodiment of the transistor unit 56 is shown in FIG. 4. The transistor circuit 56 includes a first MOSFET 64 having its source connected to ground and its gate connected to the power supply output 54. The drain of the first MOSFET 64 is connected to the gate of a second MOSFET 66 and a resistor 68. The other terminal of the resistor 68 is connected to a RTC battery 70. The second MOSFET's 66 source is also connected to ground, and its drain is connected to a second resistor 72, which has its other terminal connected to the power supply output 54.

When the computer system C is powered up, the power supply output 54 activates the first MOSFET 64, which connects the gate of the second MOSFET 66 to ground, and turns off the second MOSFET 66. This causes an open circuit between the power supply output 54 and ground, allowing the power supply output 54 to maintain 5 volts.

When the computer C is shut down, the power supply output 54 going to a low level turns off the first MOSFET 64. This opens the connection between the second MOSFET's 66 gate and ground, allowing the RTC battery 70 to activate the second MOSFET 66. This causes effectively a short circuit between the resistor 72 and ground and the total resistance to ground reduces or effectively eliminates any backfeed voltage.

The presence of the resistor 72 between the power supply output 54 and the MOSFET 66 will allow a slight voltage to remain on the power supply output 54, at least greater than if only the MOSFET 66 were present. To reach the power supply output 54, however, the backfeed voltage typically passes through high resistance pull-up resistors or other relatively high impedance sources located in the peripheral unit 28. The resistor 72 is of such low resistance compared to the peripheral unit's pull-up resistors that the backfeed voltage on the power supply output 54 remains very low, well below the level where the specific RTC current consumption problem in the 82360 SL occurs.

When the system is powered up, the power supply 52 builds up to a level of 5 volts at the power supply output 54. The connection to ground through the resistor 72 and the second MOSFET 66 would cause the voltage to decrease, but the resistance caused by the resistor 72 and MOSFET 66 are very large compared to the source impedance of the power supply 52 and the power delivery capabilities of the power supply 52. Therefore, the power supply 52 will overdrive the clamping effect of the resistor 72 and the MOSFET 66, allowing the power supply 52 to activate the first MOSFET 64, which then deactivates the second MOSFET 66 and opens the connection between the power supply output 54 and ground.

Again it is noted that the sources of the MOSFETs 64 and 66 should be connected to ground so that the inherent diode is reverse-biased during normal operations.

Thus it can be seen that circuits according to the invention allow the power supply output 54 to be grounded when the power supply 52 is shut down, countering the potential problems from backfeed voltage. When the system is operating, however, the connection to ground is opened to allow the power supply 52 to properly operate without interference.

The foregoing disclosure and description of the invention are illustrative and explanatory thereof, and various changes in the size, shape, materials, components, circuit elements, wiring connections and contacts, as well as in the details of the illustrated circuitry and construction and method of operation may be made without departing from the spirit of the invention.

We claim:

1. An electrical system, comprising:

a first electrical unit including:

a ground reference line;

means for developing a supply voltage which is provided on a supply voltage line;

electrical circuitry connected to said ground reference line and said supply voltage line for receiving a supply voltage and having an input, said input being coupled to said supply voltage line; and means connected to said ground reference line and said supply voltage line for connecting said ground reference line to said supply voltage line when said first electrical unit is turned off; and a second electrical unit including:

a ground reference line, said second electrical unit ground reference line connected to said first electrical unit ground reference line; and means for providing an output signal at a high voltage level, said output signal connected to said input of said electrical circuitry of said first electrical unit when said first electrical unit is turned off; and said electrical circuitry of said first electrical unit including means for partially transferring said output signal high voltage level to said first unit ground reference line when said first electrical unit is turned off.

2. The electrical system of claim 1, wherein said means for connecting said ground reference line to said supply voltage line includes:

means for signaling that said first electrical unit is turned on or off; and switching means coupled to said means for signalling that said first electrical unit is turned on or off and connected to said ground reference line and said supply voltage line for connecting said ground reference line to said supply voltage line when said first electrical unit is turned off.

3. The electrical system of claim 2, wherein said switching means is a transistor.

4. The electrical system of claim 3, wherein said transistor is a MOSFET and said MOSFET source is connected to said ground reference line, said MOSFET drain is connected to said supply voltage line and said MOSFET gate is connected to said means for signaling that said first electrical unit is turned on or off.

5. The electrical system of claim 2, wherein said means for connecting said ground reference line to said supply voltage line further includes:

means connected to said means for signaling that said first electrical unit is turned on or off and said switching means for delaying connection of said ground reference line to said supply voltage line for a period of time after turn off of said first electrical unit.

6. The electrical system of claim 5, wherein said switching means is a MOSFET and said MOSFET source is connected to said ground reference line, said MOSFET drain is connected to said supply voltage line and said MOSFET gate is connected to said means for signaling that said first electrical unit is turned on or off.

7. The electrical system of claim 6, wherein said means for delaying connection includes a capacitor connected from said MOSFET gate to said ground reference line.

8. The electrical system of claim 1, wherein said means for connecting said ground reference line to said source voltage line includes:

a battery connected to said ground reference line and providing an output line;

first switching means having a control input and two switch connections, said first switch connection connected to said ground reference line, said second switch connection coupled to said battery output line and said control input coupled to said source voltage line; and second switching means having a control input and two switch connections, said first switch connection connected to said ground reference line, said second switch connection coupled to said source voltage line and said control input connected to said first switch means second switch connection.

9. The electrical system of claim 8, wherein a resistor is connected between said battery output signal and said first switching means second switch connection and a resistor is connected between said source voltage line and said second switching means second switch connection.

10. The electrical system of claim 9, wherein said first and second switching means are MOSFET transistors, said control inputs being gate inputs, said first switch connections being said sources and said second switch connections being said drains.

11. The electrical system of claim 1, wherein said input of said electrical circuitry of said first electrical unit is coupled to said supply voltage line by a diode having its cathode connected to the supply voltage line and its anode connected to the input.

12. An electrical system, the electrical system capable of being connected to an electrical unit which provides a high voltage level output signal when the electrical system is turned off, the electrical system comprising:

a ground reference line;

means for developing a supply voltage which is provided on a supply voltage line;

electrical circuitry connected to said ground reference and said supply voltage line and having an input, said input being coupled to said supply voltage line, said input being connected to the electrical unit high voltage level output signal; and means connected to said ground reference line and said supply voltage line for connecting said ground reference line and said supply voltage line when the electrical system is turned off, said electrical circuitry of said electrical system including means for partially transferring the output signal high voltage level to said ground reference line when the electrical system is turned off.

13. The electrical system of claim 12, wherein said means for connecting said ground reference line to said supply voltage line includes:

means for signaling that said first electrical unit is turned on or off; and switching means coupled to said means for indicating that the electrical system is turned on or off and connected to said ground reference line and said supply voltage line for connecting said ground reference line to said supply voltage line when said first electrical unit is turned off.

14. The electrical system of claim 13, wherein said switching means is a transistor.

15. The electrical system of claim 14, wherein said transistor is a MOSFET and said MOSFET source is connected to said ground reference line, said MOSFET drain is connected to said supply voltage line and said MOSFET gate is connected to said means for indicating that the electrical system is turned on or off.

16. The electrical system of claim 13, wherein said means for connecting said ground reference line to said supply voltage line further includes:

means connected to said means for signaling that said first electrical unit is turned on or off and said switching means for delaying connection of said ground reference line to said supply voltage line for a period of time after turn off of said first electrical unit.

17. The electrical system of claim 16, wherein said switching means is a MOSFET and said MOSFET source is connected to said ground reference line, said MOSFET drain is connected to said source voltage line and said MOSFET gate is connected to said means for signaling that the electrical system is turned on or off.

18. The electrical system of claim 17, wherein said means for delaying connection includes a capacitor connected from said MOSFET gate to said ground reference line.

19. The electrical system of claim 12, wherein said means for connecting said ground reference line to said supply voltage line includes:

a battery connected to said ground reference line and providing an output line;

first switching means having a control input and two switch connections, said first switch connection connected to said ground reference line, said second switch connection coupled to said battery output line and said control input coupled to said supply voltage line; and second switching means having a control input and two switch connections, said first switch connection connected to said ground reference line, said second switch connection coupled to said supply voltage line and said control input connected to said first switch means second switch connection.

20. The electrical system of claim 19, wherein a resistor is connected between said battery output signal and said first switching means second switch connection and a resistor is connected between said supply voltage line and said second switching means second switch connection.

21. The electrical system of claim 20, wherein said first and second switching means are MOSFET transistors, said gate inputs being said control inputs, said first switch connections being said sources and said second switch connections being said drains.

22. The electrical system of claim 12, wherein said input of said electrical circuitry of said first electrical unit is coupled to said supply voltage line by a diode having its cathode connected to the supply voltage line and its anode connected to the input.

23. An electrical system for clamping power output to ground while a computer is deactivated comprising:

a computer unit including:

a computer ground reference line and a computer supply voltage line;

means for developing a computer supply voltage which is provided on said computer supply voltage line;

computer electrical circuitry connected to said ground reference line and said computer supply voltage line for receiving the computer supply voltage and having an input, said input being coupled to said computer supply voltage line; and feedback control means connected to said computer ground reference line and said computer supply voltage line for connecting said computer ground reference line to said computer supply voltage line when said computer unit is turned off; and a peripheral unit including:

a peripheral unit ground reference line, said peripheral unit ground reference line connected to said computer unit ground reference line; and said peripheral unit including means providing a peripheral unit feedback signal to said computer supply voltage line, said peripheral unit feedback signal connected to said input of said computer electrical circuitry of said computer unit when said computer unit is turned off, said feedback control means transferring said peripheral feedback signal to said computer unit ground reference line when said computer unit is turned off.

24. The electrical system of claim 23, wherein said feedback control means for connecting said computer unit ground reference line to said supply voltage line includes:

means for signaling that said computer unit is turned on or off; and switching means coupled to said means for signaling that said computer unit is turned on or off and connected to said computer ground reference line and said computer supply voltage line for connecting said computer ground reference line to said computer supply voltage line when said computer unit is turned off.

25. The electrical system of claim 24, wherein said switching means is a transistor.

26. The electrical system of claim 25, wherein said transistor is a MOSFET and said MOSFET source is connected to said computer ground reference line, said MOSFET drain is connected to said computer supply voltage line and said MOSFET gate is connected to said means for signaling that said computer unit is turned on or off.

27. The electrical system of claim 24, wherein said feedback control means for connecting said computer unit ground reference line to said computer supply voltage line further includes:

means connected to said means for signaling that said computer unit is turned on or off and said switching means for delaying connection of said computer ground reference line to said computer supply voltage line for a period of time after turn off of said computer unit.

28. The electrical system of claim 27, wherein said switching means is a MOSFET and said MOSFET source is connected to said computer ground reference line, said MOSFET drain is connected to said computer supply voltage line and said MOSFET gate is connected to said means for signaling that said computer unit is turned on or off.

29. The electrical system of claim 28, wherein said means for delaying connection includes a capacitor connected from said MOSFET gate to said computer ground reference line.

30. The electrical system of claim 23, wherein said feedback control means for connecting said computer ground reference line to said computer supply voltage line includes:

a battery connected to said ground reference line and providing an output line;

first switching means having a control input and two switch connections, said first switch connection connected to said computer ground reference line, said second switch connection coupled to said battery output line and said control input coupled to said computer supply voltage line; and second switching means having a control input and two switch connections, said first switch connection connected to said computer ground reference line, said second switch connection coupled to said computer supply voltage line and said control input connected to said first switch means second switch connection.

31. The electrical system of claim 30, wherein a resistor is connected between said battery output signal and said first switching means second switch connection and a resistor is connected between said computer supply voltage line and said second switching means second switch connection.

32. The electrical system of claim 31, wherein said first and second switching means are MOSFET transistors, said gate inputs being said control inputs, said first switch connections being said sources and second switch connections being said drains.

* * * * *

UNITED STATES PATENT AND TRADEMARK OFFICE

CERTIFICATE OF CORRECTION

PATENT NO. : 5,446,320

DATED : AUG. 29, 1995

INVENTOR(S) : SCHARNBERG ET AL.

It is certified that error appears in the above-identified patent and that said Letters Patent is hereby corrected as shown below:

In col. 6, line 19, please replace "signalling" with --signaling--.

Signed and Sealed this

Fourteenth Day of November, 1995

*Attest:*

*Attesting Officer*

BRUCE LEHMAN

*Commissioner of Patents and Trademarks*